United States Patent [19]

Shih

[11] Patent Number: 4,577,584

[45] Date of Patent: Mar. 25, 1986

[54] BELL LOCK (II)

[76] Inventor: Nan C. Shih, 116, Changstao Rd., Changhua City, Taiwan, 500

[21] Appl. No.: 685,491

[22] Filed: Dec. 24, 1984

[51] Int. Cl.[4] ..... G08B 13/08

[52] U.S. Cl. ..... 116/10; 116/97; 116/153

[58] Field of Search ..... 116/4, 9, 10, 153, 154, 116/155, 158, 159, 164, 92, 96, 97; 16/121; 70/91, 106, 141-144, 224; 292/347, 348, 352, 356

[56] References Cited

U.S. PATENT DOCUMENTS 356,606 1/1887 Thomas et al. ..... 116/9
409,762 8/1889 Stickney et al. ..... 116/9
983,626 2/1911 Kriz ..... 116/10
1,798,444 3/1931 Wood ..... 116/158

FOREIGN PATENT DOCUMENTS 311734 10/1933 Italy ..... 116/154

*Primary Examiner*—Charles Frankfort
*Assistant Examiner*—Patrick R. Scanlon
*Attorney, Agent, or Firm*—Holman & Stern

[57] ABSTRACT

An improved knob lock commonly used, which comprises a bell inside. The main part of which is a rotator which is turned by rotating either of the knobs and has two extending-out springs to which are attached a steel ball respectively at their ends. Hindrance rods, which are used to prevent the springs from passing freely, make the springs bend until they are forced past the hindrance rods to knock hard on the bell giving out a ringing sound at the same time.

2 Claims, 5 Drawing Figures

BELL LOCK (II)

BACKGROUND OF THE INVENTION

Generally speaking, a door is used to separate indoor from outdoor, and is always equipped with a lock by which we have to turn its knob to move a latch inwards so as to open the door. But, since turning the knob and opening the door won't always make a sound loud enough for persons indoors to hear it, somebody may hang a bell inside the door, which may be swung to ring while the door is opened so that the persons indoors can be warned that somebody is coming in. The object that this invention has aimed to attain is to obtain such an alarm at the same time that the knob is turned around.

SUMMARY OF THE INVENTION

When one of the knobs of this bell lock is turned by hand, not only the latch is moved inwards, but also a steel ball at each end of the two extending out of a rotator knocks on a bell with a powerful strike, surpassing a hindrance rod set on a fixing plate. So manual turning of the door knob can open the door, and can ring the bell as well to warn the entrance of a person.

DESCRIPTION OF THE PREFERRED EMBODIMENT

Figure 1:
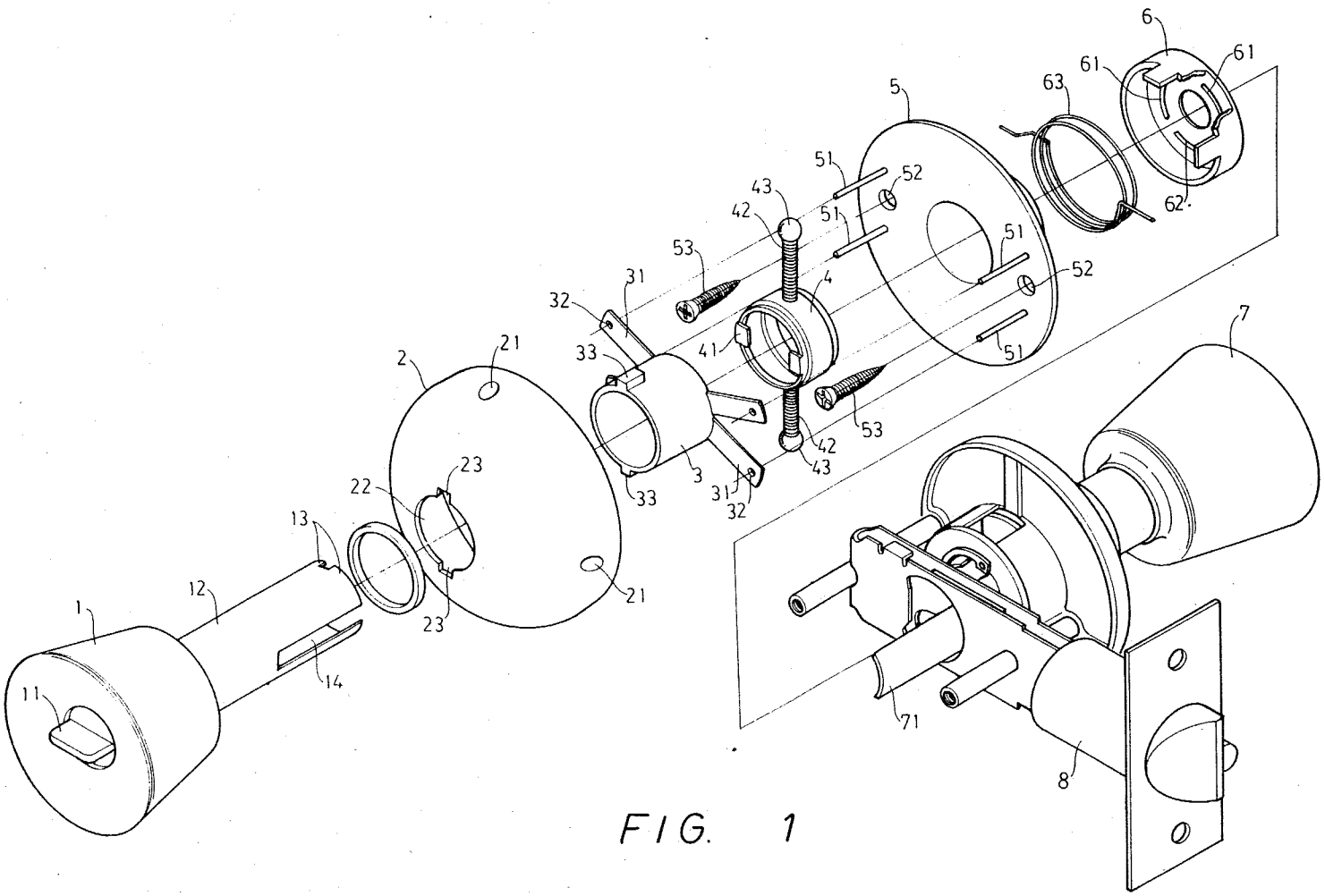
FIG. 1 is the view of the separated parts of the bell lock in this invention.

First, as shown in FIG. 1, this invention, a bell lock, comprises inside knob 1, bell 2, fixing frame 3, rotator 4, fixing plate 5, linking cover 6, outside knob 7 and latch 8. Said outside knob 7 and latch 8 are those used in common conventional door locks, and they have a lock gut, which is able to be turned and unlocked by a key after it is locked and at the same time able to move said latch 8 inwards when it is turned. And, in addition, said outside knob 7 and said latch have to be fixed up in a door.

Figure 2:
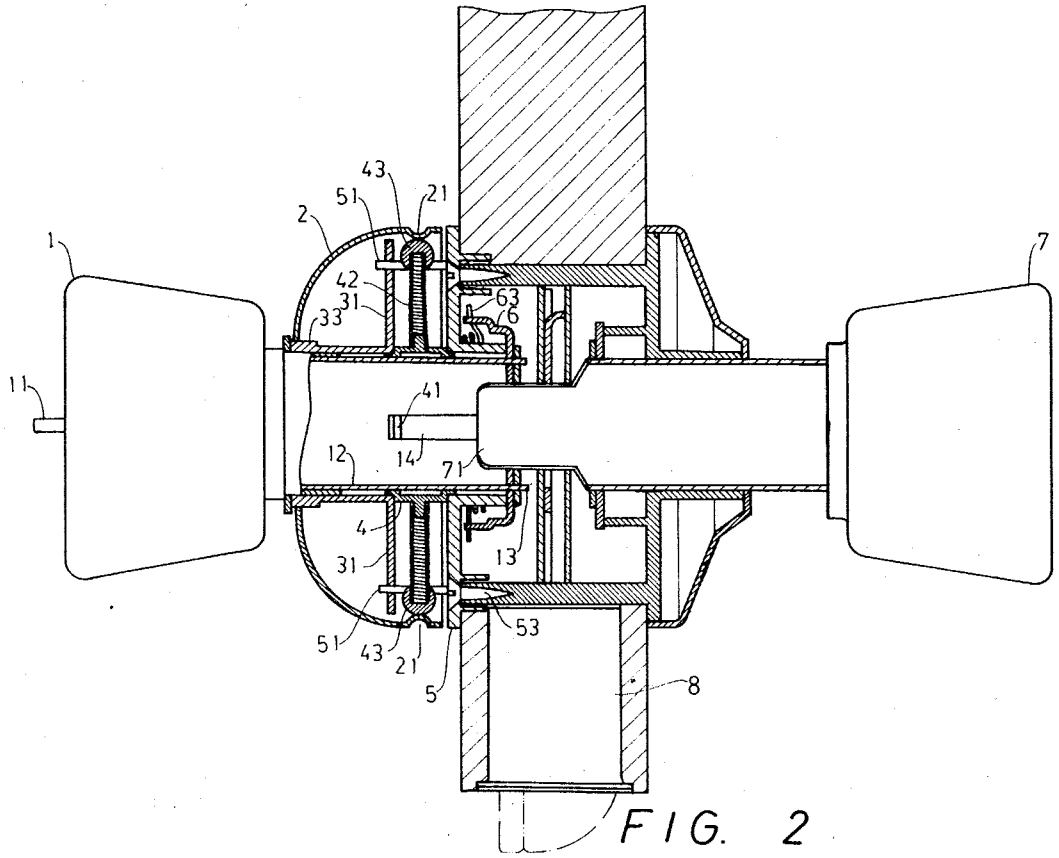
FIG. 2 is the cross-section view of this bell lock in this invention.

In order to get a more clear-cut mutual relationship between each of said parts, the detailed description, together with FIGS. 1 and 2, is to be related as follows.

Inside knob 1, comprising a conventional locking structure 11, possesses pipe shaft 12 which is able to penetrate bell 2, fixing frame 3, rotator 4 and fixing plate 5 in order. There are two protruded edges 13 at the end of pipe shaft 12, able to fit into slots 61 of linking cover 6. In addition, two straight slots 14 cut in pipe shaft 12 of inside knob 1 can fit together with tip 41 located at the interior circle of rotator 4 in order to make rotator 4 rotate at the same time that inside knob is turned.

Bell 2 is made of metal and has a plurarity of concavities 21 which are used to be knocked at by steel balls 43 of rotator 4. Hole 22 bored at the center of said bell 2 can be penetrated through by pipe shaft 12 of inside knob 1 and has two notches 23 used to fit together with tips 33 of fixing frame 3 so as to keep bell 2 at its position.

Fixing frame 3 uses four feet 31 to fit into hindrance rods 51 of fixing plate 5 through hole 32 cut on each of said feet 31 and has two tips 33 to fit together with said notches 23 of bell 2.

Rotator 4 is confined between fixing frame 3 and fixing plate 5, combined together with pipe shaft 12 of inside knob 1 and uses tips 41 to fit in slots so that it is able to be turned around by the manual turning of inside knob 1 as well. In addition, rotator 4 has two extensible and flexible springs 42 which are respectively attached with a steel ball at their ends.

The distance between the center of rotator 4 and said steel ball is longer than that between the center of fixing plate 5 and hindrance rod 51, enabling said hindrance rods 51 to hinder the moving of steel ball 43.

Fixing plate 5 has two holes 52 used for bolting said fixing plate 5 on a door, and four hindrance rods 51 used for hampering the passing of steel bells 43 of rotator 4.

Linking cover 6 is used to link inside knob 1 with outside knob 7 together. On its top there are slots 61 for protruded edges 13 of inside knob 1 to stick in and slot 62 for key plate 71 of outside knob 7 to stick in. So, when outside knob 7 is turned around, said key plate 71 can force latch 8 to move inwards and cause linking cover 6 to rotate at the same time, and inside knob 1, via pipe shaft 12, can force rotator 4 to turn around. In addition, spring 63 inserted inside linking cover 6 is able to push inside knob 1 or outside knob 7 back to its original position after it has been turned around.

Figure 3:
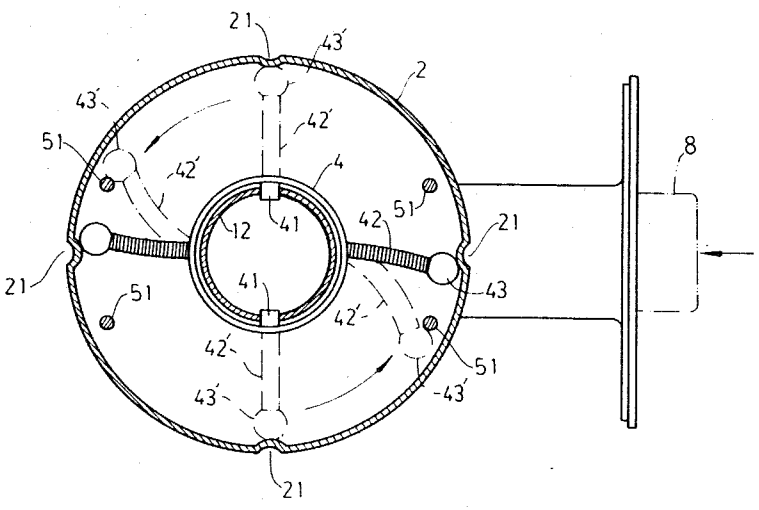
FIG. 3 is the view of the rotator turning and knocking on the bell in this invention.

Furthermore, an embodiment of how rotator 4 and bell 2 function to make sounds is shown in FIG. 3. When inside knob 1 or outside knob 7 is turned, latch 8 will move inwards, and springs 42 and steel balls 43 will make turning movement, as the arrow shows, starting from their static position 42' and 43'. Since hindrance rods 51 form hindrance against the moving of springs 42 and steel balls 43, the latter may be hindered for a very short while, but once they are forced to pass it over, they can knock strongly onto concavities 21 to make a sound of ringing.

Figure 4:
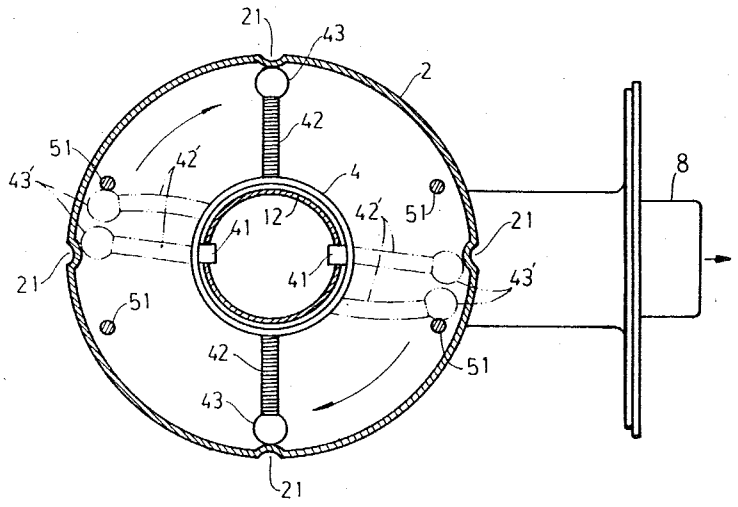
FIG. 4 is the view of the rotator returning and knocking on the bell in this invention.

Next, when the manual force for turning inside knob 1 or outside knob 7 disappears, said inside or outside knob will be automatically, because of the elasticity of spring 63, returned back to its original position as shown in FIG. 4. It shows that springs 42 and steel balls 43, as the arrow indicates, will be stopped again by said rods 51 and then knock onto concavities 21 to ring once again when forced to overpass said rods 51.

Figure 5:
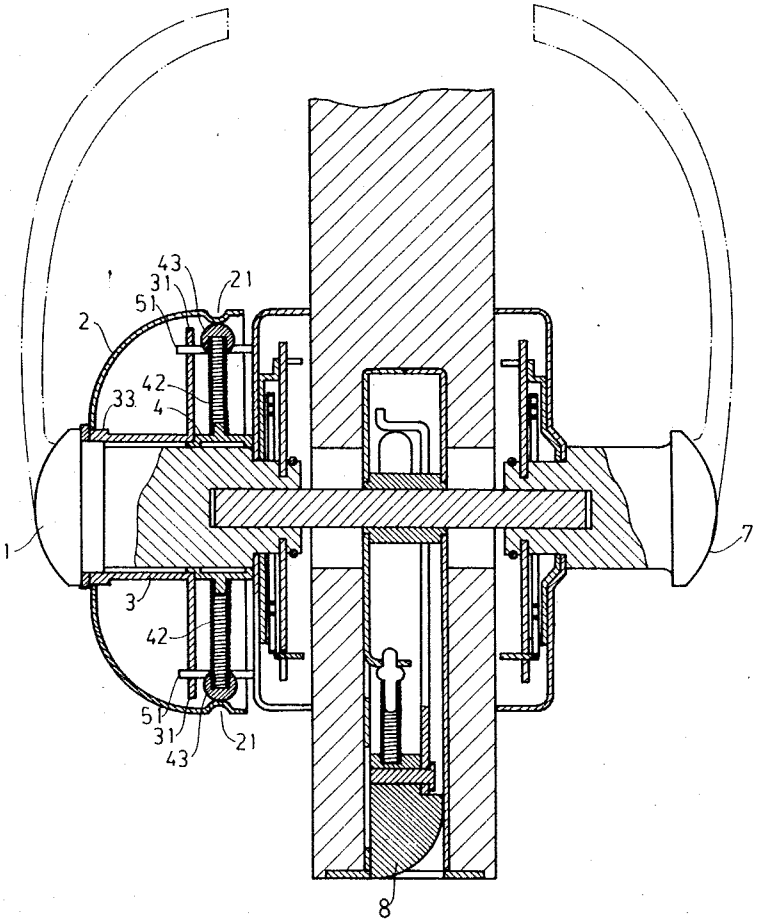
FIG. 5 is the cross-section view of the bell lock with a different shape in this invention.

What is more, as shown in FIG. 5, inside knob 1 or outside knob 7 can be changed into other shapes when can also force rotator 4 to turn and cause steel balls 43 of rotator 4 to knock onto bell 2 as above-mentioned, obtaining the object of this invention.

I claim:

1. A lockable door knob able to ring, comprising:

an inside knob constructed with a pipe shaft whose end is shaped as two protruding edges able to fix in two slots cut in a linking cover, said pipe shaft having elongate slots wherein a tip of a rotator can fit, a round-shaped bell with several pointed concavities, said rotator containing springs whose ends are each provided with a steel ball, a fixing frame fixed on hindrance rods of a fixing plate and able to restrict the position of said rotator between said fixing plate and the fixing frame, the hindrance rods combining with said fixing frame to hinder the passing of said steel balls, the linking cover combining with said protruding edges of said inside knob and with a key plate of an outside knob respectively, the key plate combining with said linking cover to force a latch to move when either said inside knob or said outside knob is turned, wherein manual rotation of said inside knob or said outside knob causes said rotator to rotate, and due to said hindrance rods said steel balls set on said rotator are temporarily hindered then forced to surpass said rods knocking against the concavities of said bell and making a sound of ringing by means of the springs set between said rotator and said balls.

2. The door knob as claimed in claim 1, including spring means urging the knobs to return to their original position and cause said rotator to counter-rotate at the same time causing said steel balls of said rotator to knock on said bell and make a further ringing sound.

* * * * *